United States Patent [19]

Brown

[11] 4,138,153

[45] Feb. 6, 1979

[54] SANITARY SELF-CONTAINED FECAL WASTE CONTAINER

[76] Inventor: Jeffrey L. Brown, 60 Bates Rd., Harrison, N.Y. 10528

[21] Appl. No.: 832,496

[22] Filed: Sep. 12, 1977

[51] Int. Cl.[2] ..... A01K 29/00; A47L 13/52

[52] U.S. Cl. ..... 294/1 R; 15/257.1; 294/55

[58] Field of Search ..... 294/1 R, 25, 19 R, 55; 15/104.8, 257.1, 257.2, 257.6, 257.7, 257.9; 150/3, 11; 229/53, 55, 62

[56] References Cited

U.S. PATENT DOCUMENTS

| | | | |
|---|---|---|---|
| 3,189,253 | 6/1965 | Mojonnier | 229/55 X |
| 3,286,826 | 11/1966 | Stoll | 229/53 X |
| 3,767,246 | 10/1973 | Corelli et al. | 294/19 R |
| 3,767,247 | 10/1973 | Wetzler | 294/1 R |
| 3,806,984 | 4/1974 | Hilsabeck | 294/55 X |
| 3,813,121 | 5/1974 | Marvin | 294/1 R |
| 3,830,423 | 8/1974 | Prescott | 294/1 R X |

*Primary Examiner*—Johnny D. Cherry
*Attorney, Agent, or Firm*—Wolder, Gross & Yavner

[57] ABSTRACT

A sanitary self-contained fecal waste container which is especially useful for cleaning up after pet animals. The unit contains a collapsible frame to which is secured a pouch, a portion of which is folded backward upon itself. The bottom portion of the frame has a forwardly extending shovel portion with a serrated edge and a rearwardly extending barrier member. Extending upwardly from the bottom portion are side and top portions separated by folds. Thence extending upwardly from the folds at the opposie ends of the top portions, are handled grip portions forming a handle.

The frame is extended, the barrier member is removed and aids in putting feces, for example on the street or sidewalk, into the pouch. The folded over portion is pulled forward to enclose the frame, shovel portion and the barrier which is placed in the pouch. The pouch may then be secured by a tie, and disposed of as desired.

2 Claims, 8 Drawing Figures

SANITARY SELF-CONTAINED FECAL WASTE CONTAINER

PRIOR ART

This invention relates to sanitary self-contained fecal waste containers, and more particularly to containers which may be very easily carried, and which may be disposed of under sanitary conditions.

A growing problem in the United States is disposal of animal pet fecal waste matter. Especially serious in urban areas, the problem continues to expand as the pet population continues to grow.

There have been many attempts in the prior art to develop a disposal fecal waste container. For example, U.S. Pat. No. 3,286,826 discloses a disposable bag with a shovel. There is also present a removable barrier, but the disposable bag and the barrier are not attached to the rigid frame.

U.S. Pat. No. 3,659,891 discloses a bag which is doubled over a non-disposable frame. In this patent, while the bag is disposable, the frame is not.

U.S. Pat. No. 3,971,503 discloses a rigid disposable frame which is part of a disposable bag, but a portion of the fixture, namely the shovel, remains external to the bag in the closed position, thus providing a non-sanitary feature.

SUMMARY OF THE INVENTION

Accordingly it is a principal object of the present invention to provide a self-contained disposable fecal waste container in which all the parts which come in contact with the fecal waste are internalized and sealed prior to disposal.

Still another object of the present invention is to provide a fecal waste container in which all the parts are small, yet easily assemblable and accessible.

Still yet another object of the present invention is to provide a fecal waste container in which the removable barrier is secured to the rigid frame, and which may be easily removed prior to use.

Still yet another object of the present invention is to provide a device of the character described in which the various elements of the collapsed unit may be easily assembled, or otherwise moved into operative condition with a minimum of effort.

Still a further object of the present invention is to provide a device which is easy to grip and to manipulate during usage.

Still yet another object of the present invention is to provide a very sanitary fecal waste container which is simple and inexpensive to manufacture and assemble, and yet is durable and highly efficient in use.

In accordance with the present invention there is provided a sanitary self-contained fecal waste container consisting essentially of a collapsible frame and a pouch permanently secured to the frame. The frame consists of a bottom shovel portion with depending side and top walls separated by fold lines. The two top lines meet in a central location where further fold lines define upwardly extending handle grip walls meeting at a central fold line. In the collapsed condition the fold lines separating the side and top walls are at the exterior of the construction with the central fold line bisecting the center of the bottom shovel portion. A pouch is secured to the inner surface of the frame with the end being doubled backward along the pouch portion. Extending rearwardly from the bottom shovel portion is a barrier member secured to the shovel portion along a tear line. In use, the fold portions separating the shovel portion and the side walls are bent upwardly thus extending the side walls and then the fold portions separating the top walls and the handle grip portions are bent upwardly allowing the handle grip walls to come in abutment with each other, thus forming a member perpendicular to the top walls and to the bottom shovel portion. The barrier wall may then be separated along the tear line from the shovel portion and the forwardly extending shovel portion is directed to the fecal waste, "shoveling" the waste into the interior of the pouch. When all the fecal waste is contained, the barrier wall is also thrown into the interior of the pouch. The end wall of the pouch is then drawn forwardly covering the frame and the shovel portion. The end wall may be secured by means of a tie and thus all the portions of the container contaminated by fecal waste are located internally of the exterior surface of the pouch, thus insuring a completely sanitary means of collecting and disposing of fecal waste matter.

The above brief description, as well as further object, features and advantages of the present invention will be more fully appreciated by reference to the following, detailed description of the preferred, but nonetheless illustrative, embodiment, when taken in conjunction with the accompanying drawings, wherein.

Figure 1:
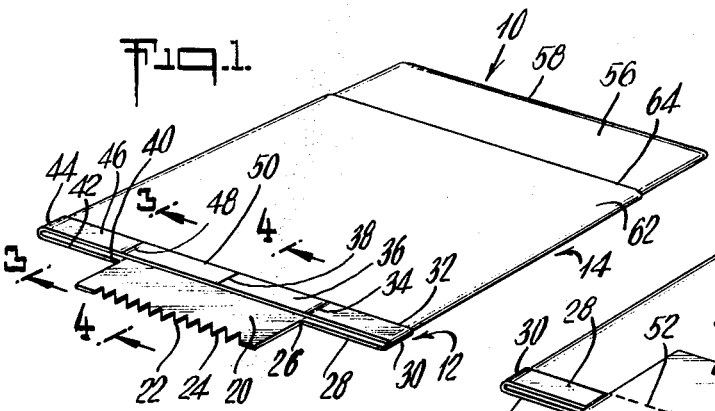
FIG. 1 is a top perspective view of a sanitary self-contained fecal waste container with the frame in collapsed condition.
Figure 2:
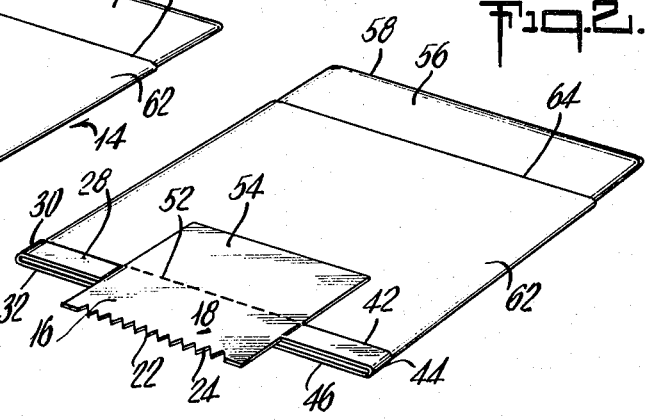
FIG. 2 is a view similar to FIG. 1 but showing the bottom of the container.

Turning to the drawings, and more particularly to FIGS. 1 and 2 there is shown a container 10 broadly consisting of a frame 12 and a pouch 14.

More particularly, the frame comprises a bottom shovel portion 16 defined by a lower surface 18 and an upper surface 20. The shovel member 22 consists of a series of teeth formed by a serrated collection edge 24. Extending outwardly from the bottom shovel portion 16 defined therefrom by a fold 26 is a right side wall 28 defined at the other end by a fold 30 and thence depending is a right top wall 32. At the opposite side of the fold 30 is a fold 34 from which depends a right handle grip wall 36, ending in a top fold 38.

Likewise, on the other side of the bottom shovel portion 16 there is a fold 40 from which depends a left side wall 42 defined at the other end by a fold 44. Thence there depends a left top wall 46 defined at its opposite end by a fold 48, and then there extends a left handle grip wall 50 terminating at the fold 38.

Figure 6:
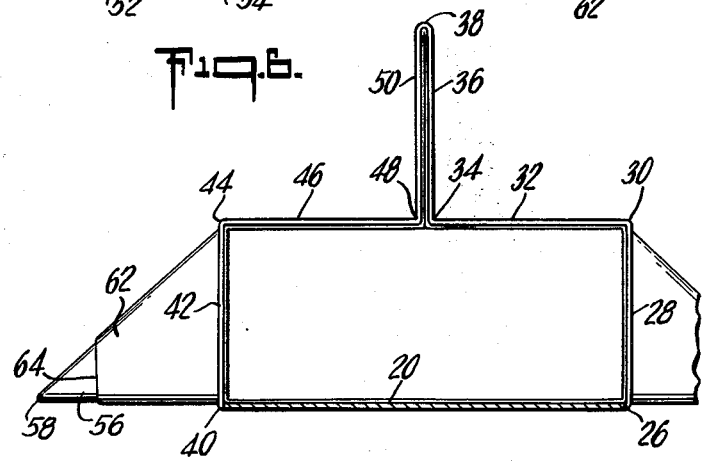
FIG. 6 is a somewhat enlarged, fragmentary cross-sectional view taken along lines 6—6 of FIG. 5.

As best seen in FIGS. 2 and 6, depending rearwardly from the bottom shovel portion 16 and defined therefrom by a tear line 52 is a removable barrier 54. It should be mentioned that the frame may be made of any disposable material which will allow a certain amount of rigidity and varying of the parts. An example of such a material is cardboard, or it could be a plastic which is capable of forming fold lines. The important feature is that the material should be capable of being disposed after a single use.

Referring to the pouch 14, this should also be formed of a disposable material, such as the plastic garbage bag. It should be noted that the receptacle or bag portion 56 terminates in a closed lower end 58. The bag extends upwardly and at some point is turned back over on itself, such as at fold line 60. The fold-over bag portion 62 extends backward over the bag 56 and finally terminates at an end portion 64. The length of the receptacle portion 56 and bag portion 62 must be sufficient to completely cover the frame, and to allow the introduction and retention of not only fecal waste matter but also the removable barrier portion as will appear hereinafter.

Figure 5:
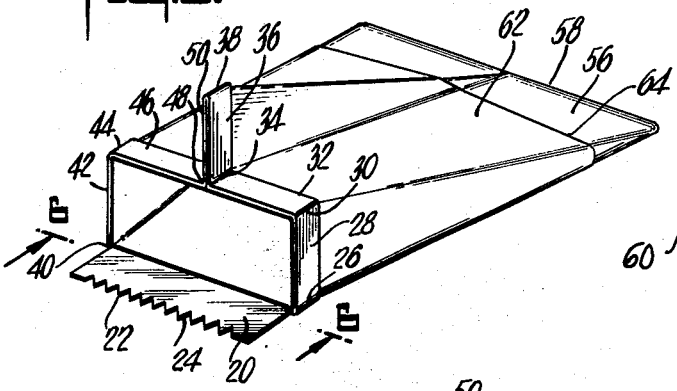
FIG. 5 is a view similar to FIG. 1 but showing the frame in its operative position.
Figure 3:
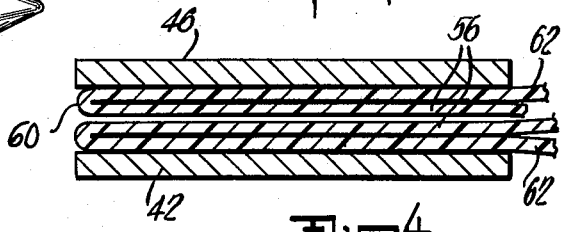
FIG. 3 is an enlarged, fragmentary cross-sectional view taken along lines 3—3 of FIG. 1.
Figure 4:
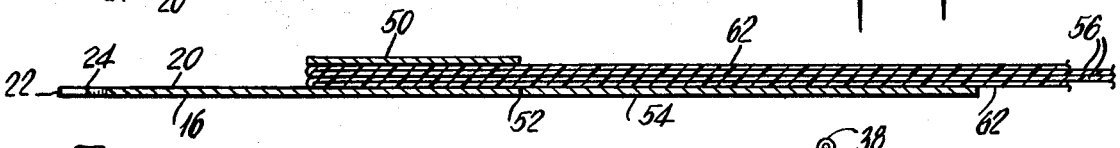
FIG. 4 is an enlarged fragmentary cross-sectional view taken along lines 4—4 of FIG. 1.
Figure 8:
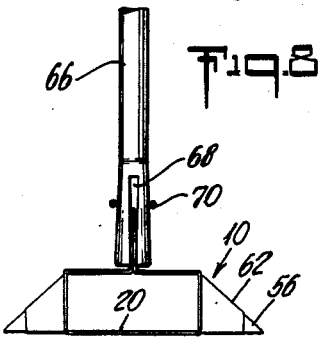
FIG. 8 is a front elevational view showing a rod-type handle surrounding the handle grip.
Figure 7:
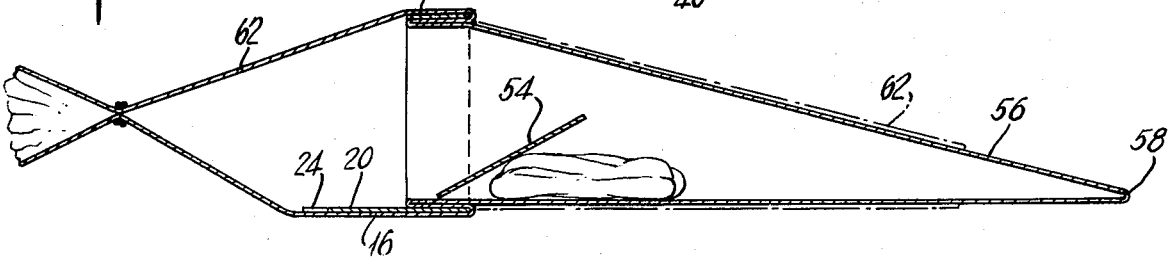
FIG. 7 is a cross-sectional view showing the feces and the barrier wall within the container, and showing the folded portion to the right in phantom and to the left in secured condition.

In use, the bag is initially removed from its storage container, such as any standard packaging that may be used to commercially offer the container for sale. The removed stored disposal container assumes the configuration of FIGS. 1 and 2. In order to make use of the bag it is necessary to extend and make the frame upright. This is done by moving the side and top walls upwardly and inwardly along the fold lines 26 and 40 so that the side walls 28, 42 assume a position which is perpendicular to the bottom shovel portion 16. Then at the fold lines 30, 44, the top wall portions 32, 46 assume a position which is parallel to the bottom shovel portion 16, and thence naturally at the fold lines 34, 48, the handle grip portions 36, 50 move into abutting and upright position terminating at the fold line 38. This position of the bag is best illustrated in FIG. 5. At this point, the removable barrier 54 may either remain secured to the bottom shovel portion 16 or it may be removed along the tear line 52. To use the unit, the abutting handle grip portions 36, 50 are gripped between the fingers of the user and the frame is moved forwardly with the serrated teeth 24 of the shovel member 22 engaging the fecal matter and thereafter shoveling it into the interior of the bag receptacle means. After all the desired fecal matter as been positioned in the bag, the removal barrier is thrown therein as well. Then the end 64 of the bag is gripped and the excess material 62 is moved forwardly until the frame is covered and the bag is moved completely forwardly. At this point a tie may be used to close off the bag. This position is best illustrated in FIG. 7.

This allows the accomplishment of the major purpose of the invention, namely the fact that the use of the present disposable container is completely sanitary. There is a complete internalization of all parts which may have become stool-contaminated. Such parts are the barrier, whether or not it has been removed, the frame and shovel portion, and even the base of the unit itself. Furthermore, if the unit has been tied in any standard means if may be deposited in any waste receptacle, even if the receptacle is of the open variety, without causing any health hazard.

In order to prevent continuous stooping, an extended rod-type handle 66 having an expanded slot 68 receiving the handle grip may be provided. Any convenient means of securely engaging the grip, such as a sliding split ring 70 may be used.

While there have been described and illustrated preferred embodiments of the present invention, it is apparent that numerous alterations, omissions and additions may be made without departing from the spirit thereof.

I claim:

1. A sanitary self-contained fecal waste container for cleaning up after pet animals comprising:

a collapsible frame having a substantially rigid bottom shovel portion and a handle grip portion receptacle means secured to the frame, a portion of said means adapted to enclose said frame together with the contents of said means whereby all contaminated portions of said frame and said means are enclosed within said means for sanitary disposal.

said receptacle means including a pouch consisting of a bag having a closed end and a double-over portion to completely internalize said collapsible frame, said shovel portion having a barrier member releasably secured to the rear edge thereof.

2. The invention according to claim 1, said shovel portion including a forwardly extending shovel member defined by a serrated edge.

* * * * *